US006286341B2

(12) United States Patent
Jackson, Jr. et al.

(10) Patent No.: US 6,286,341 B2
(45) Date of Patent: Sep. 11, 2001

(54) ELASTIC DRAWCORD PRODUCT AND METHOD OF MAKING SAME

(75) Inventors: Clyde E. Jackson, Jr., Peachtree City, GA (US); Frankie Hunt; James Burrow, Jr., both of Randleman, NC (US)

(73) Assignee: Elastic, Corporation of America, Inc., Columbia, AL (US)

( * ) Notice: Subject to any disclaimer, the term of this patent is extended or adjusted under 35 U.S.C. 154(b) by 0 days.

(21) Appl. No.: 09/782,272

(22) Filed: Feb. 13, 2001

Related U.S. Application Data

(63) Continuation of application No. 09/364,340, filed on Jul. 30, 1999, now abandoned, which is a continuation of application No. 09/012,505, filed on Jan. 23, 1998, now abandoned.

(51) Int. Cl.[7] ..... D04B 11/00; A41D 1/14

(52) U.S. Cl. ..... 66/83; 66/170; 66/172 E; 2/221; 2/237

(58) Field of Search ..... 66/80, 81, 82 R, 66/83, 84 R, 84 A, 85 R, 203, 170, 172 E, 1 R, 61, 192; 2/243.1, 220, 221, 237, 236, 76, 338, 311; 24/712

(56) References Cited

U.S. PATENT DOCUMENTS

| | | |
|---|---|---|
| Re. 21,522 | 8/1940 | Brown . |
| Re. 33,586 | 5/1991 | Graff . |
| 747,809 | 12/1903 | Velasko . |

(List continued on next page.)

FOREIGN PATENT DOCUMENTS

| | | |
|---|---|---|
| 371754 | 10/1963 | (CH) . |
| 854561 | 9/1952 | (DE) . |
| 8101964 | 7/1981 | (DE) . |
| 2568900 | 8/1984 | (FR) . |
| 16195 | 8/1893 | (GB) . |
| 632522 | 1/1950 | (GB) . |
| 1208426 | 10/1970 | (GB) . |
| 1392199 | 4/1975 | (GB) . |
| 1406821 | 9/1975 | (GB) . |
| 1456922 | 12/1976 | (GB) . |
| 49-26044 | 3/1974 | (JP) . |
| 50-15643 | 2/1975 | (JP) . |
| 50-19548 | 3/1975 | (JP) . |
| 50-30646 | 3/1975 | (JP) . |
| 1392200 | 4/1975 | (JP) . |
| 50-41717 | 4/1975 | (JP) . |
| 51-52044 | 5/1976 | (JP) . |
| 52-41077 | 3/1977 | (JP) . |
| 56-34824 | 4/1981 | (JP) . |

*Primary Examiner*—Danny Worrell
(74) *Attorney, Agent, or Firm*—Wolf, Greenfield & Sacks, P.C.

(57) ABSTRACT

A method of knitting an elastic drawcord product and an elastic band and drawcord composite product are described. The method involves knitting a pair of elastic webs in a laterally spaced relationship to each other, and securing a drawcord within the space between the elastic webs by way of first and second tying yarns. The first tying yarn reciprocates across the space between the first and second elastic webs and is alternatively secured to the side edges thereof along the front face of the elastic webs. The second tying yarn reciprocates across the space between the first and second elastic webs and is alternatively secured to the side edges thereof along the rear face of the webs, and the drawcord is secured between the two elastic webs and the first and second tying yarns. The tying yarns can be reciprocated for a number of courses, then held along the side of one of the webs for a predetermined number of courses before resuming reciprocation, to form sets of tie legs which cover spaced apart portions of the space between the elastic webs. The elastic drawcord product can be integrally formed on a knitting machine with the drawcord being inserted while the elastic threads in the elastic webs are in an extended form, to provide a drawcord with an effective length which is longer than that of the elastic band in its unextended condition.

21 Claims, 6 Drawing Sheets

U.S. PATENT DOCUMENTS

| | | |
|---|---|---|
| 782,819 | 2/1905 | Biklé . |
| 975,947 | 11/1910 | Grewen . |
| 1,291,048 | 1/1919 | McKevitt et al. . |
| 1,309,487 | 7/1919 | Reeser et al. . |
| 1,666,325 | 7/1928 | Chisholm . |
| 1,672,017 | 6/1928 | Wright . |
| 1,729,817 | 10/1929 | Bullard . |
| 1,732,266 | 10/1929 | Glendinning et al. . |
| 1,789,823 | 1/1931 | Lehman . |
| 1,825,271 | 9/1931 | Karberg . |
| 1,951,450 | 3/1934 | Sochel . |
| 2,072,020 | 2/1937 | Barmon . |
| 2,080,246 | 5/1937 | Wengen . |
| 2,088,302 | 7/1937 | McKeever . |
| 2,147,772 | 2/1939 | Kallander . |
| 2,197,186 | 4/1940 | Lilley . |
| 2,259,236 | 10/1941 | Wellins et al . |
| 2,274,382 | 2/1942 | Richman . |
| 2,349,019 | 5/1944 | Terrell . |
| 2,364,903 | 12/1944 | Howard . |
| 2,390,423 | 12/1945 | Carter . |
| 2,391,674 | 12/1945 | Brown et al. . |
| 2,392,221 | 1/1946 | Brady . |
| 2,393,151 | 1/1946 | Debate . |
| 2,482,644 | 9/1949 | Wilker . |
| 3,172,430 | 3/1965 | Weidhaas . |
| 3,868,729 | 3/1975 | Lynam . |
| 3,887,968 | 6/1975 | Lynam . |
| 4,229,835 | 10/1980 | Shaw . |
| 4,466,137 | 8/1984 | Carnaghi . |
| 4,477,928 | 10/1984 | Graff . |
| 4,665,909 | 5/1987 | Trainor . |
| 5,040,244 | 8/1991 | Tubbs . |
| 5,186,779 | 2/1993 | Tubbs . |
| 5,375,266 | 12/1994 | Crisco . |
| 5,452,591 | 9/1995 | King . |
| 5,758,519 | 6/1998 | Joyce et al. . |
| 5,787,510 | 8/1998 | Jackson, Jr. . |
| 5,963,988 | 10/1999 | Jackson, Jr. . |

ELASTIC DRAWCORD PRODUCT AND METHOD OF MAKING SAME

This application is a continuation of application Ser. No. 09/364,340, filed Jul. 30, 1999, now abandoned which is a continuation of application Ser. No. 09/012,505, filed Jan. 23, 1998, now abandoned.

BACKGROUND OF THE INVENTION

1. Field of the Invention

The invention generally relates to an elastic band product having an attached drawcord, and a method of raking the same. More specifically, the invention relates to an elastic drawcord product having a drawcord secured between first and second elastic webs by tying yarns, and a method of making such a drawcord product on a knitting machine.

2. Description of the Prior Art

Elastic bands are commonly used in combination with drawstrings, particularly in apparel applications. For example, elastic bands and drawstrings are commonly used to secure items of apparel about a wearer's waist, e.g., in sweatpants, men's bathing suits, and the like. In such articles, the elastic band usually provides the initial cinching of a garment, while the drawstring is used to further cinch the garment once donned by the wearer, and to secure it in this cinched form.

The elastic band/drawstring combinations are typically secured within a tunnel located proximate the area of the garment where cinching is desired, e.g., at the waist of the garment. In some garments, the tunnel is pre-formed, and an opening is provided through which the elastic band and drawstring can be fed. In this method, the ends of the elastic band are then secured together while the drawstring ends are left loose, in order that they can be pulled through the tunnel opening, and subsequently tied or otherwise secured together by the garment wearer to cinch the garment as desired. In other typical methods, the elastic band and drawstring are provided on a peripheral portion of a garment, which is in turn folded over the elastic band and drawstring and secured in place, to form a tunnel integrally from the garment itself which surrounds portions of the band and drawstring. In these methods, the ends of the elastic band can be secured together to form a ring-shaped band prior to the formation of a tunnel, or they can be extended through a tunnel opening and secured together subsequent to the sleeve forming operation, in the manner described above. In some of the methods, the elastic band is actually sewn to the garment, while in others, the band floats freely within the tunnel.

One drawback of the elastic band/drawstring combinations is that it can be relatively labor intensive to apply them to the garments. To overcome this problem, several attempts have been made to provide the elastic band and drawstring as a single unit. One such attempt is described in U.S. Pat. Nos. 5,040,244 and 5,186,779 to Tubbs. The Tubbs patents describe an elastic band/drawstring combination having a drawstring adhesively secured to the surface of an elastic band, and its associated method of production. While providing a convenient means for furnishing both an elastic band and a drawstring, the adhesive used must be relatively weak in order that the bond between the drawstring and the elastic band can be broken following insertion of the band into a garment so that the drawstring can be used to cinch the garment. As a result, the combination requires proper handling in order that the adhesive attachment between the drawcord and the elastic band is not broken prematurely.

Another method is described in U.S. Reissue Pat. No. 33,586 to Graff. The Graff patent describes an elastic band having a pull cord incorporated within the elastic band structure in the place of or in addition to one of the elastic threads forming the elastic band. In the embodiment illustrating a knit band structure, the filling threads forming the elastic band extend continuously across the full width of the structure, with the pull cord being incorporated into the structure of the elastic band itself. In order that a proper Length of pull cord to elastic band is achieved (i.e., so that the pull cord is longer than the elastic band), the patent describes that the pull cord is "bunched" within the elastic band.

Other elastic band/drawstring combinations are described in U.S. Pat. No. 5,375,266 to Crisco and U.S. Pat. No. 5,452,591 to King. The Crisco patent describes an elastic band having a drawstring sewn to its surface, while the King patent describes the formation of a combination structure by knitting a conventional elastic band, then re-routing the band back through the knitting machine where a tunnel-like cover is knit over a drawcord to secure it to the elastic band. In each of these combinations, the ratio of drawcord to elastic band is limited by the sewn/knit cover over the drawcord, and the sewing and knitting must be performed precisely in order that the cord is not inadvertently sewn or knit to the elastic band. Further, the thickness of the combination structure formed according to each of these patents in the region of the drawstring tends to be relatively thick, since it includes the combined thicknesses of the drawstring plus that of the elastic band and knit or sewn cover.

SUMMARY OF THE INVENTION

With the foregoing in mind, it is an object of the present invention to provide an elastic band and drawcord combination which can be easily secured to a garment, and which can be readily and easily manufactured.

It is also an object of the invention to provide an elastic band and drawcord combination having a desirable ratio of drawcord length to elastic band length.

It is a further object of the invention to provide a method of making an elastic band and drawcord combination using only a minimal number of manufacturing steps.

These and other objects are achieved through the provision of an elastic drawcord product having a first elastic band section and a second elastic band section, with the band section being secured together in a laterally spaced relationship by a plurality of tie legs formed by two or more tying yarns, and with a drawcord being secured in the space between the first and second elastic webs by way of the tie legs. In a preferred form of the invention, the elastic-webs are in the form of conventional knit elastic bands, and the tying yarns reciprocate across the space between the first and second elastic webs and are secured to the edges thereof. In a particularly preferred form of the invention, a first tying yarn reciprocates between the first and second elastic webs and is secured to the side edges along the front faces of the webs to form a series of front tie legs, while a second tying yarn reciprocates between the first and second elastic webs and is secured to the side edges along the rear faces of the webs to form a series of rear tie legs. The drawcord is secured between the first and second webs and the first and second tying yarns.

The elastic drawcord product of the invention is desirably made by simultaneously knitting first and second elastic webs in a laterally spaced-apart manner, to define a space between the webs, while feeding a first tying yarn in a reciprocating manner across the space, such that the yarn is alternatingly secured to the respective webs along a front face thereof, and feeding a second tying yarn in a reciprocating manner such that the yarn is alternatingly secured to the respective webs along a rear face thereof, while feeding a drawcord between the first and second webs such that the drawcord is captured between the first tying yarn and the second tying yarn, to thereby form a composite elastic drawcord product.

In one preferred form of the invention, the first tying yarn is reciprocatingly fed between the first and second webs for a predetermined number of courses to form a first set of tying yarns, then is fed to only one of the elastic webs for a number of courses such that the tying yarn extends along a side edge thereof. The reciprocation of the tying yarn is then resumed to form a second set of tie legs which extend across the space between the first and second elastic webs. The process of alternately reciprocating and holding the first tying yarn is repeated along the length of the elastic bands to form a plurality of spaced-apart tie leg sets. The second tying yarn is desirably fed in the same manner, to form a plurality of spaced-apart tie leg sets which extend along the length of the elastic webs. In a particularly preferred form of the invention, the location of the tie leg sets of one of the tying yarns is coordinated so as to correspond with the spaces between the tie leg sets of the other yarn and vice versa; in this way, only a single tying yarn extends across the space between the elastic webs at any given point along the length of the webs. (It is to be noted that the terminology "single tying yarn" is meant in its broadest sense, and includes multifilament and multi-component yarns, which may have one or more ends, as well as those formed from a single yarn or filament). Alternatively, composite cord products made according to the instant invention could include some overlap of the tie leg sets formed by the respective first and second tying yarns, provided the tie leg sets of at least one of the tying yarns are spaced to allow easy gripping and retraction of the drawcord outwardly from the composite structure.

The elastic webs are knit under tension, such that the elastic threads therein are in their extended condition during the knitting process. The drawcord is desirably relatively less elastic than the elastic webs, and because the drawcord is being inserted as the elastic webs are being formed, the length of drawcord inserted in the elastic drawcord product is greater than the length of the elastic webs in their relaxed, unextended condition. Thus, upon completion of the formation of the composite drawcord product, when the tension on the elastic webs is released, the extra length of the drawcord is realized and tends-to extend outwardly from the bands between the individual or adjacent sets of tie legs. In this way, a composite product having a desirable ratio of drawcord to elastic web can be readily and efficiently achieved with the drawcord being positioned within the composite structure where it is readily and easily graspable for withdrawal from the composite structure. If additional drawcord length is desired (i.e., a drawcord having greater length than the elastic webs in their maximally extended condition), such length of drawcord can be inserted into the space between the elastic webs. In this way, the optimal ratio of drawcord length to elastic band length for a given use can be readily produced. Also, by controlling the number of reciprocations in the individual tie leg sets and the degree of stretchability of the yarns in the elastic webs, the tying yarns, and the drawcord, the functional characteristics of the composite product can be selected to achieve the desired results.

In another preferred form of the invention, the intermittent tie legs extend across the drawcord on one face of the product, and filler yarns extend across the drawcord on the opposite face.

Although in a preferred form of the invention, the tying yarns are elastomeric, other types of yarns, such as flat or stretch yarns, polyester yarns, nylon yarns, polypropylene yarns, and the like, can be used with-n the scope of the instant invention. The flexibility and stretch provided to the tie legs by the elastomeric tying yarns further cause the drawcord to protrude outwardly from the faces of the webs, where a user may more easily grasp the drawcord for cinching. Further, the use of elastomeric tying yarns assists in the manufacturing process by making it easier to insert the drawcord in its desired position between the elastic webs. In addition, the tying legs can thus be formed while the yarn is under tension, such that when the tension on the tying yarns is subsequently removed, the tie legs closely surround the drawcord in a secure manner.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
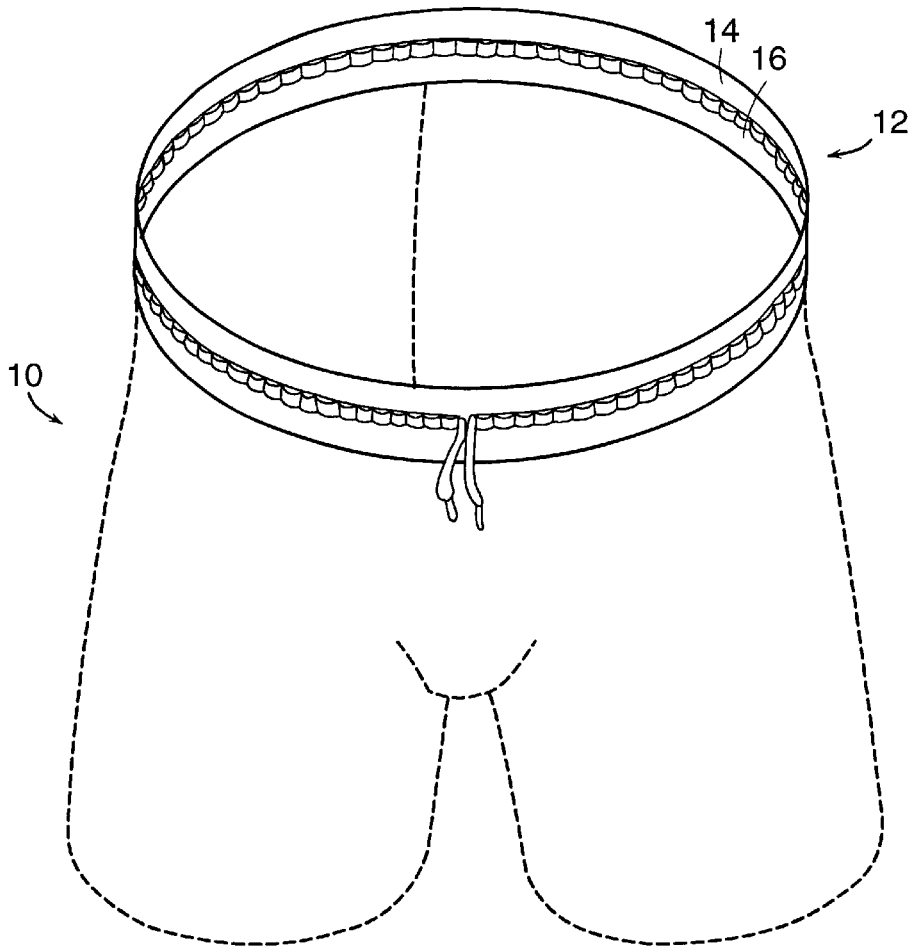
FIG. 1 is an environmental perspective view of a garment incorporating an elastic drawcord product according to the instant invention, with the drawcord as it appears in its uncinched condition.
Figure 3:
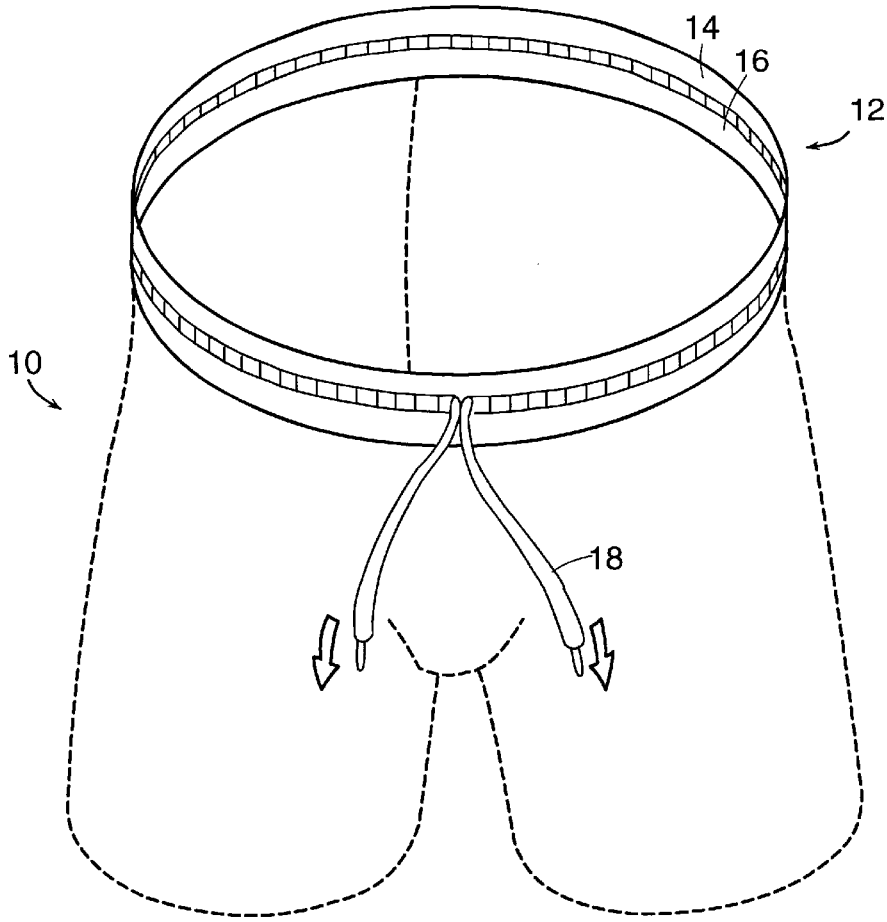
FIG. 3 is an environmental perspective view of the garment shown in FIG. 1 illustrating the elastic drawcord product as it appears with the drawcord in its cinched condition.

With reference to the drawings, FIGS. 1 and 3 illustrate a garment 10 incorporating an elastic drawcord product 12 according to the instant invention. As illustrated, the elastic drawcord product 12 is stitched to the upper circumference of a pair of men's sweatpants. It is noted, however, that elastic drawcord products made according to the instant invention can be secured to a garment in any conventional manner, such as by positioning them within a sleeve having an opening through which the drawstrings can be pulled to tighten and cinch the garment about a wearer's body. Similarly, the elastic drawcord product is not Limited to apparel uses only, rather the product can be used in any environment where a combination of an elastic band and a drawcord would be desirable.

Figure 2:
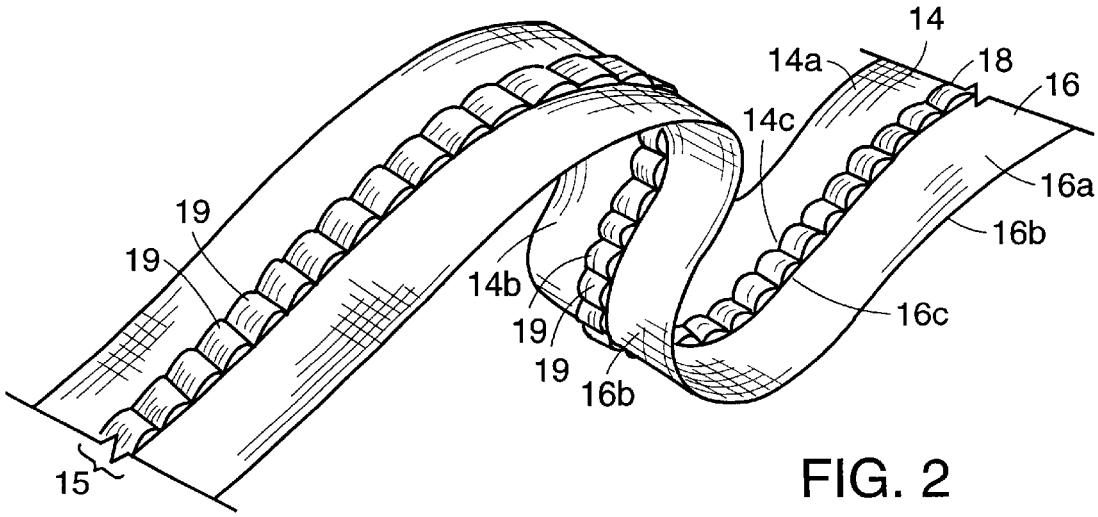
FIG. 2 is an enlarged perspective view of the elastic drawcord product illustrated in FIG. 1, showing the drawcord as it appears in its uncinched condition.

FIG. 1 shows the composite elastic drawcord product 12 secured to the garment as it appears when the drawcord is in its uncinched condition, i.e., when the drawcord has not been tightened about what in this case would be the wearer's waist. As shown in FIG. 2, the elastic drawcord product 12 includes first and second elongate elastic webs 14, 16 which may define a common plane and which are laterally spaced apart from each other to define a space 15 therebetween, and which further define a longitudinal direction. Each of the elastic webs respectively includes a front face 14*a*, 16*a*, a rear face 14*b*, 16*b*, and longitudinally extending side edges 14*c*, 16*c*. A drawcord 18 is positioned within the space between the elastic webs 14,16 and as illustrated in FIGS. 1 and 2, when the drawcord is in its uncinched condition, it may form a plurality of protuberances 19 on the front and back of the composite structure. Although illustrated as being a flat tape-like drawcord, it is noted that any type of elongate structure can be used, including those having any desired configuration and/or structure. For example, braided, woven or knit cords, ropes, or tapes can be used, as well as those having rounded or flattened cross-sections and those which are elastic or inelastic. Particularly preferred for use as drawcords are lambknit cords, flat woven tapes, and flat braided tapes. The drawcord 18 is also desirably relatively less elastic than the elastic webs 14, 16.

Figure 4:
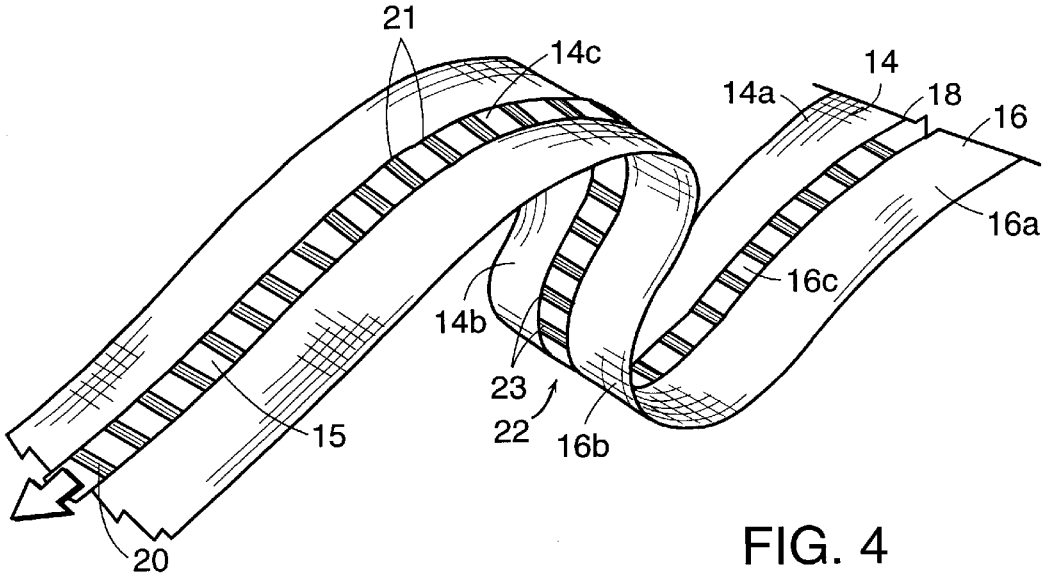
FIG. 4 is an enlarged perspective view of the elastic drawcord product illustrated in FIG. 3, showing the drawcord as it appears in its cinched condition.

As shown more clearly in FIGS. 3 and 4, the drawcord 18 is movably secured in its position between the elastic webs 14, 16 and generally in the longitudinal direction by way of first and second tying yarns 20, 22. The first tying yarn 20 reciprocates across the space 15 and is alternatingly secured to the side edges 14*c*, 16*c* of the elastic webs 14, 16 along a front face 14*a*, 16*a* thereof. (Although described as being secured "to the side edges", this terminology is intended in its broadest sense, to include embodiments where the tying yarn is secured proximate the side edges as well as those embodiments where the tying yarn is secured to more than just the edge-most wale of each of the band section. For example, the tying yarns could be secured within the three edge-most wales of the webs, as opposed to just the single edge-forming wale of the webs.)

Similarly, the second tying yarn 22 reciprocates between the first and second elastic webs 14, 16 and is alternatingly secured to the side edges 14*c*, 16*c* thereof along a rear face 14*b*, 16*b* thereof. In a preferred form of the invention, the first tying yarn 20 reciprocates for a number of courses to form a first set of tie legs 21, then is held along the side edge 14*c*, 16*c* of one of the elastic webs 14, 16 such that the space 15 between the elastic webs is uncovered for a predetermined length. The reciprocation of the first tying yarn 20 then resumes to form a second set of tie legs 21 extending between the first and second elastic webs 14, 16. This reciprocation and holding pattern is desirably repeated for the length of the elastic webs 14, 16.

Likewise, in a preferred form of the invention the second tying yarn 22 reciprocates for a predetermined number of courses to form a first set of tie legs 23, then is held along the side edge of one of the elastic webs such that the space 15 between the elastic webs is uncovered for a predetermined number of courses. The reciprocation of the second tying yarn 22 then resumes to form a second set of tie legs 23, with this reciprocation and holding pattern being continued along the length of the elastic drawcord product. In this way, the drawcord 18 which is held between the elastic webs 14, 16 by way of the first and second tying yarns 20, 22 is left uncovered at the spaces between adjacent tie leg sets, where it is readily accessible to a user for cinching of the band. The number of courses through which the tying yarns are reciprocated and held can be varied according to the desires of the manufacturer, size of the yarns being used to form the elastic webs, drawcord sizes, degree of elasticity of the respective elements and the like; it has been found to be desirable to reciprocate each of the tying yarns for about 3–10 courses, then hold them for the same number of courses. In a preferred embodiment of the invention, each of the tying yarns is reciprocated for 5 knit courses, then held along one band section side edge for 5 courses. It is to be noted, however, that one of the respective tying yarns could be reciprocated for a number of courses, then the other tying yarn could be reciprocated for a different number of courses, in order to vary the performance and appearance of the band. For example, the first tying yarn could be reciprocated for 3 knit courses, then held while the second tying yarn is reciprocated for 10 courses, with this pattern being repeated to form a composite structure where the drawcord has a tendency to protrude more from one surface of the composite (i.e., that adjacent the first tying yarn which has a pattern of spaced-apart relatively short tie leg sets) than the other surface.

In a particularly preferred form of the invention, the reciprocation and holding patterns of the first and second tying yarns 20, 22 are coordinated with only one of the tying yarns reciprocating at a time, such that only a single layer of tie legs is formed along any given portion of the space 15 between the elastic webs 14, 16. Because the drawcord 18 is inserted between the respective first and second tying yarns, it is exposed by the spaces between the respective adjacent tie leg sets 21, 23. In this way, a user is readily enabled to pull the drawcord at any given point along the length of the elastic drawcord product to cinch the same as desired. Further, by providing the spaces on both the front and rear faces of the elastic drawcord product, a user is enabled to cinch the drawcord from either or both faces of the elastic drawcord product at any given time. Alternatively, the first and second tying yarns can be positioned so that portions of one of the tie leg sets overlie portions of a tie leg set formed by the other tying yarn. In other words, in some instances both the first and second tying yarns could be reciprocated simultaneously for one or more courses. As a further alternative, only one of the first and second tying yarns could form, spaced-apart tie leg sets, while the other tying yarn reciprocates more frequently and consistently, so that few or no spaces are located between adjacent tie legs formed by that tying yarn.

As illustrated by the comparison of FIG. 1 to FIG. 3, in order to cinch the elastic drawcord product 12, a user need only pull on the drawcord 18 (e.g., by grasping an exposed portion thereof, such as one of the plurality of protrusions or protuberances 19 thereof which may extend outwardly from the elastic webs 14, 16.) Pulling away o- the drawcord at least partially flattens the protrusions. The protrusions may define a plurality of at leas: partial loops. The plurality of protrusions may define a longitudinally-extending pattern that extends along the length of the elastic web from first and second sides of the elastic webs. Because of the excess drawcord provided (which is initially in the form of the protuberances 19), a desirable ratio of drawcord length to elastic web length is provided, which can be readily grasped and withdrawn from the band, and tied into a knot or a bow.

To form the elastic drawcord product into a waistband, the ends of the elastic webs 14, 16 are secured together to form a ring-shaped article, preferably by sewing. This can be done either before or after the band is positioned on a garment. The ends of the drawcord 18 can likewise be secured together or, is as illustrated in the embodiment shown in FIGS. 1 and 3, the ends can be left free for tying together. Where the drawcord 18 ends are initially secured together along with the elastic webs 14, 16, a user can simply pull one of the protuberances 19 to cinch the drawcord product The thus released length of drawcord 18 can then be knotted while still in its continuous form, or it can be cut to form two free drawcord ends.

Figure 5:
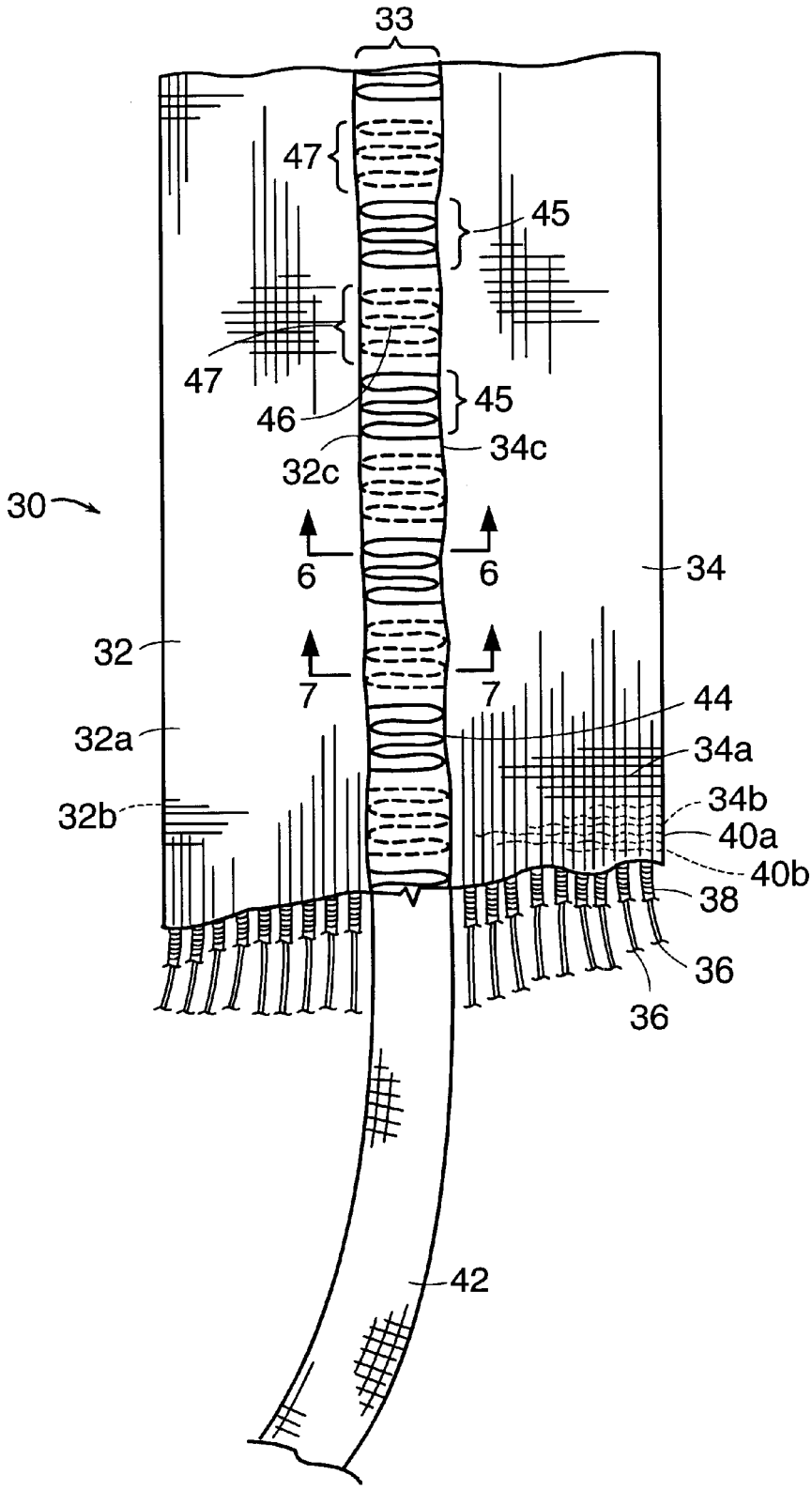
FIG. 5 is an enlarged plan view of a section of the elastic drawcord product according to the instant invention having a cut-away end portion to illustrate the various individual components.
Figure 6:
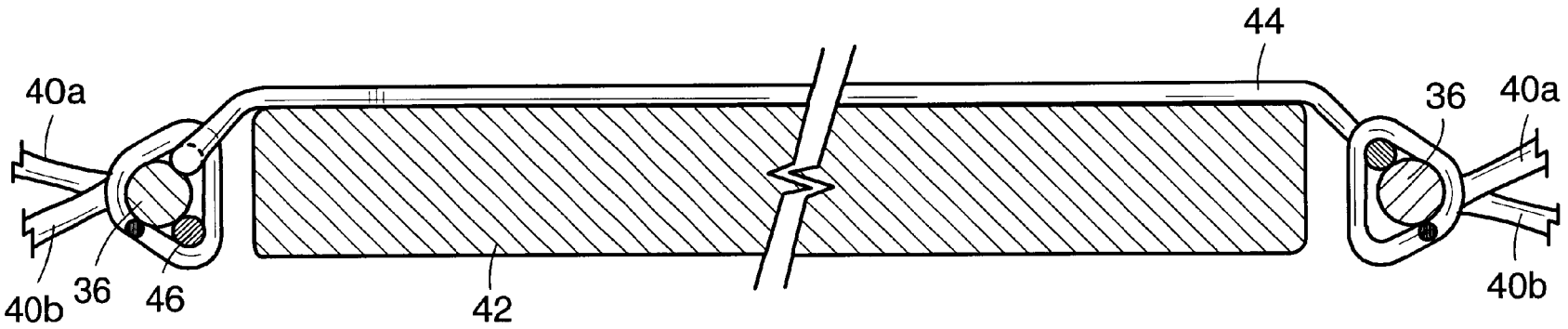
FIG. 6 is a cross-sectional view taken along lines 6—6 of FIG. 5.
Figure 7:
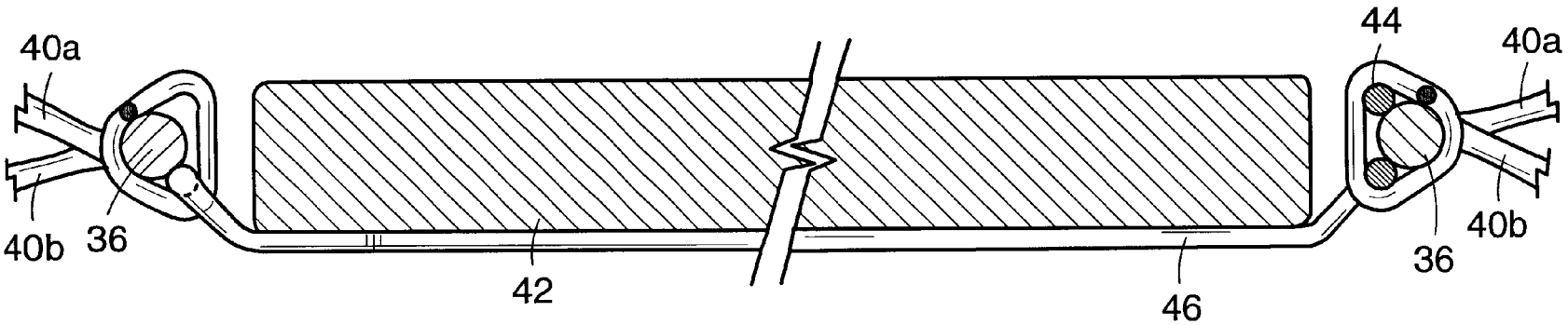
FIG. 7 is a cross-sectional view taken along lines 7—7 of FIG. 5.

The structure of the elastic drawcord product is more clearly illustrated in FIGS. 5–7. The section of an elastic drawcord product is shown generally at 30. The elastic drawcord product includes first and second elastic webs 32, 34 which are laterally spaced relative to each other to define a space 33 therebetween. Each of the elastic webs 32, 34 respectively includes a front face 32*a*, 34*a*, a rear face 32*b*, 34*b*, and a longitudinally extending side edge 32*c*, 34*c*. These elastic webs 32, 34 can be made in any conventional manner and are desirably each of the same knit construction. For purposes of illustration, the formation of one of the elastic webs will be described, with it being understood that the second band section can be produced in the same manner. The elastic webs 32, 34 desirably include elastic cords extending in a longitudinal direction, such as those shown at 36. In a preferred form of the invention, these elastic cords are rubber threads; however, the cords can be any type of elastic yarn or cord conventionally used in the formation of elastic bands.

As in the manner of conventional elastic band constructions, the elastic webs 32, 34 are desirably produced on a warn knitting machine such as a crochet machine, with the elastic cords 36 being fed to the machine under tension so that they are in their stretched or extended condition. Examples of knitting machines used to manufacture elastic bands are crochet machines distributed by OMM, Muller, and Comez. A warp yarn 38 is desirably fed to each active needle, with each of the warp yarns being knit to form a warp chain about each of the elastic cords 36. At the same time, first and second filling yarns 40*a*, 40*b* are fed in a coursewise direction where they are captured by the warp yarn chains 38 to thereby form a stable fabric structure. Filling yarns 40*a* reciprocate across the front of the elastic band structure while filling yarns 40*b* reciprocate across the back of the elastic band section to form the rear face thereof.

As described above, the first tying yarn 44 reciprocates across the space 33 between the first and second elastic webs 32, 34 where it is secured to each of the elastic webs along the front face 32*a*, 34*a* thereof in an alternating manner. Preferably, the tying yarn is secured to or proximate the side edges 32*c*, 34*c* of the respective elastic webs. Similarly, the second tying yarn 46 reciprocates across the space 33 and is secured to the elastic webs 32, 34, preferably at or proximate a side edge 32*c*, 34*c* along a rear face 32*b*, 34*b* thereof. A drawcord 42 is secured to the structure between the respective elastic webs 32, 34 and between the first tying yarn 44 and the second tying yarn 46 such that the drawcord is securely held yet freely movable relative to the tying yarns and the elastic webs . In a preferred form of the invention, the first and second tying yarns 44, 46 are secured to the side edges 32*c*, 34*c* of the elastic webs 32, 34 by their being captured by the warp yarn chains 38 as they are being formed. In this way, the first and second tying yarns 44, 46 can be formed simultaneously with the elastic webs 32, 34.

In a preferred embodiment of the invention, the first tying yarn 44 reciprocates for a predetermined number of courses to form a first tie leg set 45, then such held such that it extends along the side edge 32*c*, 34*c* of one of the elastic webs 32, 34 for a predetermined number of courses. The first tying yarn 44 then resumes its reciprocation across the space 33 between the elastic webs 32, 34 to form a second tie leg set 45, then is held again such that it extends along the side edge 32*c*, 34*c* of one of the elastic webs 32, 34 for a Predetermined number of courses. In this way, the space 33 between the elastic webs 32, 34 is alternatingly covered by the tie leg sets 45 of the first tying yarn 44 and then not covered by the tie leg sets such that a plurality of spaced apart sets of tie legs are formed. Likewise, the second tying yarn 46 is secured to the first and second elastic webs 32, 34 in the same manner. In this way, the drawcord 42 is effectively retained within the elastic drawcord product 30 while relatively large sections of the drawcord are uncovered such that they are freely graspable by a user of the product. Further, because the drawcord forms protuberances which extend outwardly from the composite structure, they are readily available to the garment manufacturer and wearer to be pulled outwardly. Furthermore, garment manufacture is enhanced because a desirable length of drawcord can be provided within the composite structure.

In a particularly preferred embodiment of the invention, the positioning of the spaced-apart tie leg sets 45 of the first tying yarn 44 are coordinated to correspond with those of the second tying yarn 46, such that the tie leg sets 45, 47 of one of the tying yarns 44, 46 correspond to the spaces between the tie leg sets formed by the other of the tying yarns. In this way, for this embodiment only a single tying yarn extends across the space between the elastic webs 32, 34 at any given point along the length of the elastic webs.

Figure 8:
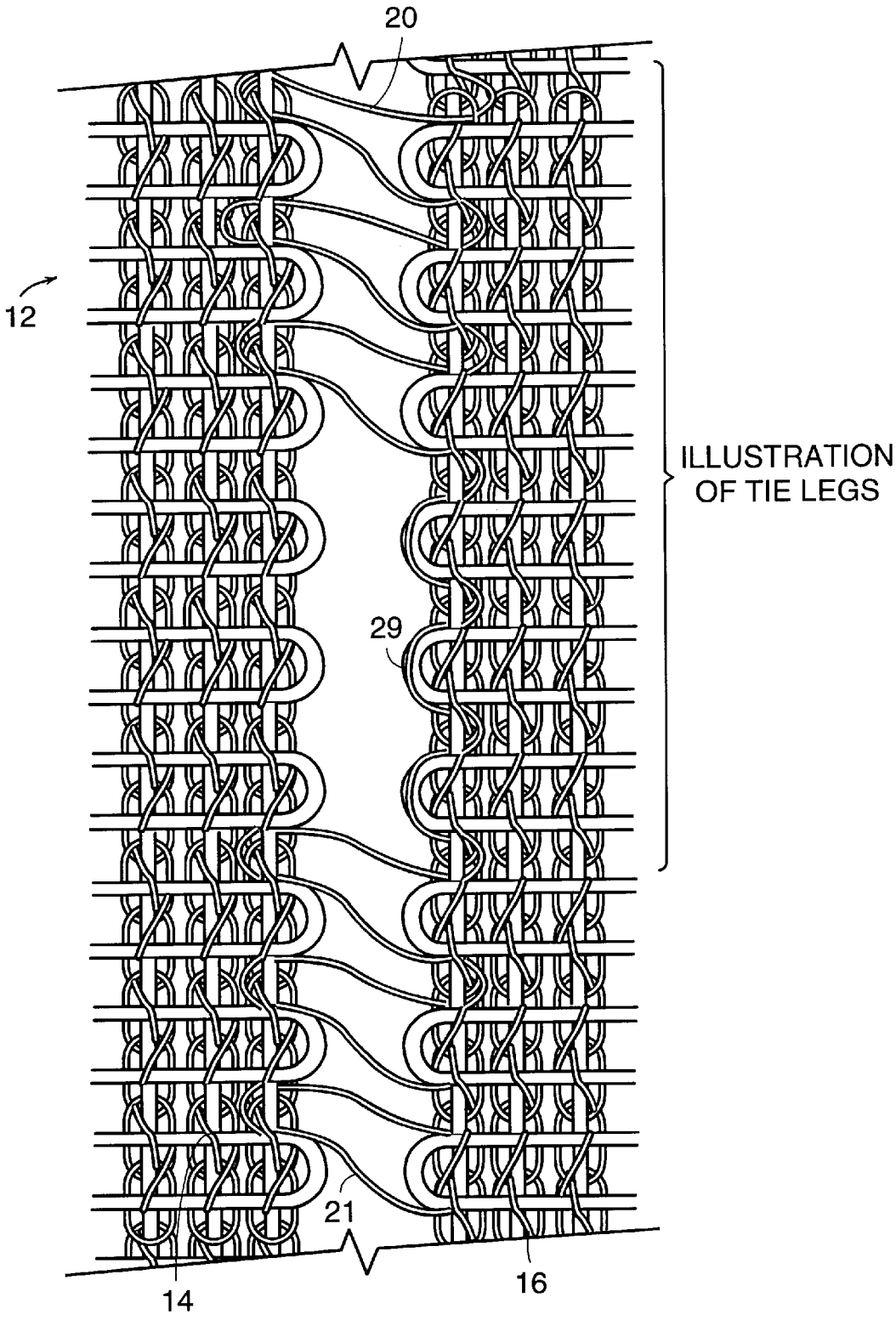
FIG. 8 is an enlarged plan view which illustrates a yarn structure formic tie legs interconnecting parallel elastic webs.

FIG. 8 shows, in enlarged detail, the structure of the parallel knitted elastic webs 14 and 16 as they are joined by the tying yarns, only one of the tying yarns, here yarn 20 which forms tie legs 21, as shown in this illustration; however, it is to be understood that the tying yarns 22 and tie legs 23 may be formed in identical or substantially similar fashion, albeit preferably at alternating intervals as described hereinabove, i.e., the tie legs 21 are formed along the length of the product 12 at intervals where the legs 23 do not appear.

The embodiment shown in FIG. 8 illustrates sets of six tie legs 21 formed at spaced apart intervals. At portions of the product 12 at which the legs 21 do not extend, the yarn 20 may be knitted in along the edgewise wale of one of the knitted bands, such as the knitted band 16. The knitted in portion is designated at number 29. The other tying yarn 22 and legs 23 may also be knitted in in a similar fashion on either of the webs 14 or 16, at suitable intervals. The knitted-in portions 29 may be formed along the edgewise wale of the knitted fabric 14 or 16, or alternatively, may be set in by one or more wales.

When knitting on a warp knitting machine, one segment of the tie legs 21 and one segment of the knitting portion 29 is formed by operating the machine to form the structure as illustrated in FIG. 8.

The width of the space defined by the length of the tie legs 21, 23 may vary according to the size of the drawcord to be retained between the webs 14, 16 and the pullout force desired. In preferred embodiments, the width between the knitted webs 14 and 16 may be about the same as defined by three or four yarns of the knitted fabrics. In general, increasing the space between the webs 14 and 16 reduces the gripping force acting on a drawcord 18.

In preferred embodiments, the ratio of the drawcord to the web is less than or equal to about 1.6 length units of cord to 1 length unit of the webs 14, 16 in a relaxed state. However, it has been found possible to make the invention with a cord to web length ratio of at least 2 to 1. Other ratios, both larger and smaller, may be chosen to effect the objects of the invention, as will be readily apparent to persons of skill in the art. During manufacture of the product 12, the ratio may be changed by changing the tensioning of the drawcord 18 as it is knitted between the webs 14, 16.

Figure 9:
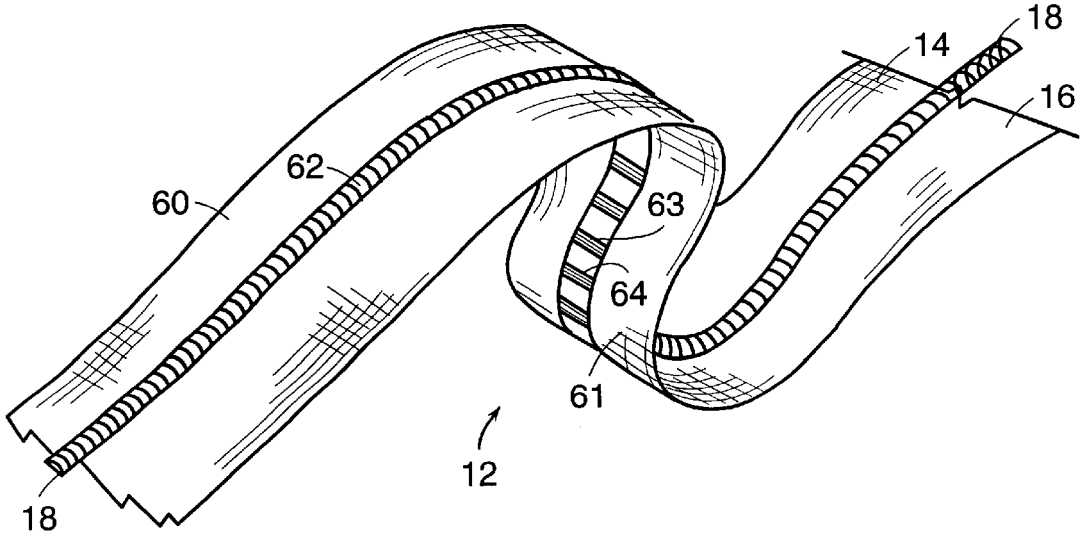
FIG. 9 is an enlarged perspective view of an alternate embodiment of the invention.

Another alternative embodiment of the invention is shown in FIG. 9. Here, the webs 14, 16 of the product 12 lie on opposite sides of a drawcord 18. The webs 14, 16 have a first side 60 and a second side 61. On the first side 60, the drawcord 18 is retained by a plurality of filler yarns 62, which may extend entirely across (or may be knitted into) the webs 14, 16, or any desired part thereof, and further, which essentially cover the drawcord 18. The filler yarns are preferably polyester. On the second face 61 of the webs 14, 16, a tying yarn 63 forms intermittent tie legs 64. The tie legs 64 are formed essentially as shown in FIG. 8 and described in the accompanying portion hereof. These tie leg sets 64 are preferably formed of elastic yarns. This embodiment may minimize, or even eliminate, any undulation of the drawcord 18 within the product 12. In addition, the lack of elasticity of the filler yarns 62 on the first side 60 of the product 12 provides, in general, for lower cord to relaxed web ratios. Most advantageously, the use of filler yarns 62 that completely, or substantially completely, cover the drawcord 18 on the face 60 of the product 12 is advantageous in that t facilitates sewing the product 12 directly to the inside of a garment, without formation of a fabric tunnel to contain the product 12. Thus, the face 60 may be exposed on the interior surface of the garment, and the drawcord 18 is pulled out at a suitable point between the yarns 62 so that the drawcord may be adjusted. The embodiment shown in FIG. 9 has been found particularly advantageous in that it provides the user of the product 12 with a desirable cord to web length ratio and the option of installing the product 12 within a tunnel or exposed within a garment. Either face 60 or 61 may be positioned on the interior face of the garment, as desired, in particular applications, either within a tunnel or in an exposed condition.

In addition, the use of filler yarn 62 on one side of the drawcord 18 and tie legs 64 on the other reduces the amount of impression that results on the drawcord, which would be apparent as the drawcord 18 is pulled out of the product 12. Thus, a superior esthetic condition of the drawcord 18 is achieved.

A preferred method of the instant invention for producing elastic drawcord products is performed as follows: a plurality of elastomeric cores are fed to a crochet-type knitting machine under tension, so that they are in an extended condition. The cores are in two or more laterally spaced-apart groups, so as to form at least two elastic webs. Preferred are elastomeric cores formed from natural or synthetic rubber, and those of spandex such as the type sold under the tradename LYCRA®.

A warp yarn is fed to each core, and the warp yarns are knit in a conventional manner for making elastic bands, such as by knitting a warp chain around each elastomeric core. Preferred for forming the warp yarns are very fine denier yarns of polyester, nylon, cotton, or combinations thereof, though it is to be understood that other yarns can be used within the scope of the invention.

While the warp chains are being knit, at least one filling yarn is fed to a front side of each discrete elastic band section, while a filling yarn is likewise fed to the rear side of each discrete elastic band section. The filling yarns are fed in a reciprocating manner, so as to be caught in the warp chains as they are being knit, thereby joining the adjacent elastomeric cores together to form a stable fabric structure. Preferred for the filling yarns are synthetic yarns such as polyester, although other types of yarns, e.g., nylon or polypropylene, can be used within the scope of the instant invention.

While the knitting of the elastic webs is taking place, a first tying yarn is fed to front sides of the elastic webs in a reciprocating manner, so that the first tying yarn is alternatingly secured to the side edges of the respective elastic webs along a front face thereof. In a particularly preferred method of the invention, the first tying yarn is secured to the side edges of the elastic webs by securing it within the warp yarn chains forming the side edges of the respective elastic webs. The second tying yarn is fed in a like manner (i.e., reciprocating between the side edges of the first and second elastic webs), but it is secured to the rear face of each of the respective elastic webs.

In a particularly preferred method of the invention, the first tying yarn is fed in a reciprocating manner for a predetermined number of courses, then it is held along the side edge of one of the elastic webs, so that the tying yarn extends along the edge-forming warp chain thereof. The reciprocating feeding motion is then resumed, to form a second tie leg set. This pattern is continued along the length of the elastic webs. The second tying yarn is likewise alternately reciprocatingly fed or held along a side edge of one of the elastic webs to form a plurality of spaced-apart tie leg sets. In a particularly preferred form of the invention, the respective tying yarns are held along side edges of opposite elastic webs, so as to produce a balanced fabric structure. As discussed above, it is desirable that the tying yarns be elastomeric, such as spandex, natural or synthetic rubber, or the like, as the elastomeric yarns enhance the protrusion of the uncinched drawcord outwardly from the elastic webs, thereby making it easier to grasp and cinch by a user.

While the first and second tying yarns are being fed into place, a guide tube desirably delivers a drawcord to a position between the first and second elastic webs, such that the first tying yarn reciprocates along a front side of the drawcord and the second tying yarn reciprocates along the rear face of the drawcord, to thereby secure the drawcord in its desired position within the composite structure. In this way, the drawcord is captured within by the first and second tying yarns as they are being formed simultaneously with the first and second elastic webs. The guide tube holds the drawcord in a proper position so as to prevent the drawcord from interfering with the knitting of the elastic bands or formation of the tie leg sets. As discussed above, because the elastic webs are knit while the elastomeric cores are under tension, the tension on the elastic webs is released and the elastomeric cores are allowed to return to their unstretched, relaxed condition. It is also contemplated, within the scope of the invention, that a positive feed means could be provided to insert additional length of drawcord between the first and second tying yarns, to thereby provide a greater amount of drawcord to a given length of elastic band section.

Many modifications and other embodiments of the invention will come to mind to one skilled in the art to which this invention pertains having the benefit of the teachings presented in the foregoing descriptions and the associated drawings. For example, although disclosed in connection with an all-knit product, it is contemplated that portions of the product structure (e.g., the elastic webs) could be woven, with the tying yarns being secured to the warp yarns proximate the side edges of the elastic webs. Therefore, it is to be understood that the invention is not to be limited to the specific embodiments disclosed and that modifications and other embodiments-are intended to be included within the scope of the appended claims. Although specific terms are employed herein, they are used in a generic and descriptive sense only and not for purposes of limitation.

That which is claimed:

1. A method of making an elastic drawcord product comprising the steps of:

knitting first and second elastic webs in a laterally spaced-apart relationship relative to each other, said webs having front and rear band surfaces and longitudinally extending side edges, and while knitting the webs, feeding a first tying yarn in a reciprocating manner between the first and second elastic webs such that said tying yarn is secured to an edge of each of the webs along the front surfaces thereof, and feeding a second tying yarn in a reciprocating manner between the first and second elastic webs such that the tying yarn is secured to an edge of each of the webs along the rear surfaces thereof, and feeding a drawcord between the first and second elastic webs such that said drawcord is captured between said first tying yarn and said second tying yarn, to thereby form a composite drawcord product.

2. A method according to claim 1, wherein said step of feeding said first tying yarn comprises feeding said first tying yarn between said first and second webs a predetermined number of courses to form a first set of tie legs from said first tying yarns, then feeding said first tying yarn to only one of said elastic webs for a number of courses such that said tying yarn extends along a side edge thereof, then resuming reciprocation of said first tying yarn between said first and second webs for a predetermined number of courses to form a second set of tie legs from said first tying yarns, to thereby define a space between said first and second sets of first tying yarns.

3. A method according to claim 2, wherein said step of feeding said second tying yarn comprises feeding said second tying yarn between said first and second webs a predetermined number of courses to form a first set of tie legs from said second tying yarns, then feeding said second tying yarn to only one of said elastic webs for a number of courses such that said tying yarn extends along a side edge thereof, then resuming reciprocation of said second tying yarn between said first and second webs for a predetermined number of courses to form a second set of tie legs from said second tying yarns, to thereby define a space between said first and second sets of second tying yarns.

4. A method according to claim 3, wherein the steps of feeding the first and second tying yarns are performed such that each tying yarn defines a plurality of longitudinally spaced-apart tie leg sets along the length of the elastic webs.

5. A method according to claim 4, wherein said steps of feeding said first and second yarns are performed such that the spaces between the tie leg sets formed by the first tying yarn correspond with the tie leg sets formed by the second tying yarn, and the spaces between the tie leg sets formed by the second tying yarn correspond with the tie leg sets formed by the first tying yarn, such that only a single tying yarn extends between the first and second elastic webs at any given point along their length.

6. An elastic drawcord product comprising:

first and second elastic webs oriented in a laterally spaced-apart relationship to each other to define a longitudinally extending space therebetween, each band section having a front surface, a rear surface and a longitudinally extending side edge;

a first tying yarn reciprocating across said space and alternatingly secured to the side edges of each of the webs along the front surface thereof to define a plurality of substantially width-wise extending tie legs;

a second tying yarn reciprocating across said space and alternatingly secured to the side edges of each of the webs alone the rear surface thereof to define a plurality of substantially width-wise extending tie legs; and a drawcord positioned in said space between the first and second elastic bands and between the first and second tying yarns, said drawcord being adapted for relative movement with respect to the tying yarns and elastic webs.

7. An elastic drawcord product according to claim 6, wherein said first tying yarn defines a series of spaced-apart tie leg sets, with each tie leg set including a plurality of individual tie legs.

8. An elastic drawcord product according to claim 7, wherein said second tying yarn defines a series of spaced-apart tie leg sets, with each tie leg set including a plurality of individual tie legs.

9. An elastic drawcord product according to claim 8, wherein the tie leg sets of the first tying yarn correspond to the spaces formed between the tie leg sets of the second tying yarn, such that only a single tying yarn extends between the first and second elastic webs at any given point along their length.

10. An elastic drawcord product according to claim 8, wherein each of said tie leg sets comprises about 3 to about 10 individual tie legs.

11. An elastic drawcord product according to claim 10, wherein each of said tie leg sets comprises about 5 individual tie legs.

12. An elastic drawcord product according to claim 6, wherein said drawcord is relatively less elastic than said elastic webs.

13. An elastic drawcord product according to claim 12, wherein said first and second tying yarns are selected from the group consisting of flat yarns, stretch yarns, elastomeric yarns, polyester yarns, nylon yarns, and polypropylene yarns.

14. A elastic drawcord product according to claim 13, wherein said first and second tying yarns are elastomeric.

15. An elastic drawcord product according to claim 6, wherein said drawcord is selected from the group consisting of lambknit cords, flat woven tapes, ropes, elastic bands, and flat braided tapes.

16. A cinchable garment comprising a body portion adapted to cover a portion of a wearer's body and an elastic drawcord product including first and second elastic webs oriented in a laterally spaced-apart relationship to each other to define a longitudinally extending space therebetween, with each band section having a front surface, a rear surface, and a longitudinally extending side edge;

a first tying yarn reciprocating across said space and alternatingly secured to the side edges of each of the webs along the front surface thereof to define a plurality of substantially width-wise extending tie legs;

a second tying yarn reciprocating across said space and alternatingly secured to the side edges of each of the webs along the rear surface thereof to define a plurality of substantially width-wise extending tie legs; and a drawcord positioned in said space between the first and second elastic bands and between the first and second tying yarns, said drawcord being adapted for relative movement with respect to the tying yarns and elastic webs, to thereby cinch the garment about a wearer.

17. A garment according to claim 16, wherein said first tying yarn of said elastic drawcord product defines a series of spaced-apart tie leg sets, with each tie leg set including a plurality of individual tie legs, and said second tying yarn defines a series of spaced-apart tie leg sets, with each tie leg set including a plurality of individual tie legs, and wherein the tie leg sets of the first tying yarn correspond to the spaces formed between the tie leg sets of the second tying yarn, such that only a single tying yarn extends between the first and second elastic webs at any given point along their length.

18. A garment according to claim 16, wherein each of said tie leg sets comprises about 5 individual tie legs.

19. A method of making a cinchable garment comprising the steps of:

providing a fabric body portion which is adapted to cover a portion of a wearer's body; and installing on said fabric body portion an elastic drawcord product having first and second elastic webs oriented in a laterally spaced-apart relationship to each other and defining a longitudinally extending space therebetween, with each band section having a front surface, a rear surface, and a longitudinally extending side edge, a first tying yarn reciprocating across said space and alternatingly secured to the side edges of each of the webs along the front surface thereof to define a plurality of substantially width-wise extending tie legs, a second tying yarn reciprocating across said space and alternatingly secured to the side edges of each of the webs along the rear surface thereof to define a plurality of substantially width-wise extending tie legs, and a drawcord positioned in said space between the first and second elastic webs and between the first and second tying yarns, with the drawcord being adapted for relative movement with respect to the tying yarns and elastic webs to cinch the fabric body portion about a user.

20. A method according to claim 19, wherein said drawcord extends outwardly from the elastic webs in the form of at least one protuberance, and further comprising the step of grasping the protuberance and pulling it outwardly from said elastic bands to thereby withdraw a portion of the drawcord from the elastic drawcord product.

21. A method of making an elastic drawcord product comprising the steps of:

knitting first and second elastic webs in a laterally spaced-apart relationship relative to each other, said webs having front and rear band surfaces and longitudinally extending side edges, and while knitting the webs, feeding a first tying yarn in a reciprocating manner between the first and second elastic webs such that said tying yarn is secured to an edge of each of the webs along the front surfaces thereof, and feeding a second tying yarn in a reciprocating manner between the first and second elastic webs such that the tying yarn is secured to an edge of each of the webs along the rear surfaces thereof, and feeding a drawcord between the first and second elastic webs such that said drawcord is captured between said first tying yarn and said second tying yarn, to thereby form a composite drawcord product.

* * * * *